US010724210B2

(12) United States Patent
Hayes et al.

(10) Patent No.: US 10,724,210 B2
(45) Date of Patent: Jul. 28, 2020

(54) HYDRAULIC ACTUATOR ARRANGEMENT

(71) Applicant: Caterpillar Inc., Peoria, IL (US)

(72) Inventors: Oliver Martyn Hayes, Leicester (GB); Simon Richard Conway, Royal Leamington Spa (GB)

(73) Assignee: Caterpillar Inc., Peoria, IL (US)

( * ) Notice: Subject to any disclaimer, the term of this patent is extended or adjusted under 35 U.S.C. 154(b) by 275 days.

(21) Appl. No.: 15/709,878

(22) Filed: Sep. 20, 2017

(65) Prior Publication Data

US 2018/0094407 A1 Apr. 5, 2018

(30) Foreign Application Priority Data

Sep. 30, 2016 (GB) ..... 1616650.6

(51) Int. Cl.
*E02F 9/22* (2006.01)
*F15B 15/28* (2006.01)
*E02F 9/26* (2006.01)

(52) U.S. Cl.
CPC ..... *E02F 9/2271* (2013.01); *F15B 15/283* (2013.01); *E02F 9/264* (2013.01); *F15B 15/2815* (2013.01)

(58) Field of Classification Search
USPC ..... 73/168
See application file for complete search history.

(56) References Cited

U.S. PATENT DOCUMENTS 3,160,836 A 12/1964 Farley
4,121,504 A 10/1978 Nowak
5,341,724 A 8/1994 Vatel
6,234,061 B1 * 5/2001 Glasson ..... F15B 15/283 33/763
6,546,780 B1 4/2003 Palfenier et al.
6,898,877 B1 5/2005 Loeb
9,012,831 B2 4/2015 Riepertinger
9,217,448 B2 12/2015 Kageyama et al.
9,309,099 B2 * 4/2016 Dal Dosso ..... B66F 9/183
9,347,763 B2 5/2016 Ikegami et al.
2005/0007099 A1 * 1/2005 Hamasagar ..... G01D 5/485 324/175
2005/0160864 A1 * 7/2005 Glasson ..... F15B 15/283 74/500.5

(Continued)

FOREIGN PATENT DOCUMENTS

CN 201121621 Y 9/2008
CN 101280796 A 10/2008
CN 202092604 U 12/2011

(Continued)

*Primary Examiner* — Clayton E. LaBalle
*Assistant Examiner* — Warren K Fenwick

(57) ABSTRACT

A hydraulic actuator with a sensor mounted on the actuator cylinder for determining the position of the actuator. The arrangement comprises a hydraulic actuator which includes a cylinder having a bore in which a piston is slidably mounted for movement along the cylinder to extend and retract the hydraulic actuator. The cylinder has a side wall and a cylinder aperture extending through the side wall. A wire actuated encoder is mounted on the external surface of the cylinder, which has a wire which extends through the cylinder aperture and is attached to the piston for determining a stroke position of the piston within the cylinder.

8 Claims, 6 Drawing Sheets

(56) References Cited

U.S. PATENT DOCUMENTS

| | | | | |
|---|---|---|---|---|
| 2014/0326039 | A1 | 11/2014 | Ikegami et al. | |
| 2015/0314548 | A1* | 11/2015 | Schwelling | B30B 15/24 100/46 |

FOREIGN PATENT DOCUMENTS

| | | | | |
|---|---|---|---|---|
| CN | 202483988 | | | 10/2012 |
| CN | 202483988 | U | * | 10/2012 |
| CN | 103499269 | A | | 1/2014 |
| EP | 0866306 | | | 9/1998 |
| JP | 11-036367 | A | | 2/1999 |
| JP | 11036367 | A | * | 2/1999 |
| JP | 04-558531 | B2 | | 10/2010 |

* cited by examiner

HYDRAULIC ACTUATOR ARRANGEMENT

TECHNICAL FIELD

The present disclosure relates to a hydraulic actuator arrangement, and in particular to a hydraulic actuator arrangement comprising a sensor mounted on the actuator cylinder for determining the position of the actuator.

BACKGROUND

Many construction and agricultural machines utilise hydraulic actuators to operate various components such as work tools. For example, backhoe loaders and excavators typically have a digging bucket on the end of a two-part articulated arm. The two-part articulated arm may comprise a 'boom', which is mounted on the backhoe loader, and a 'stick' (also known as a 'dipper'), which is articulated to the boom and carries the bucket. The movement of the various components may be controlled via hydraulic actuators. Hydraulic fluid is usually directed to the hydraulic actuators, which are typically cylinder-piston arrangements, via flexible hoses and various valves.

It may be useful to detect the position of the hydraulically actuated components of the machine, as this may enable the machines to have features that improve productivity, safety and increase their lifespan. This measurement may be performed in a number of ways, such as measuring the relative rotation of the hydraulic cylinder about a pivot point or comparing signals generated by encoders mounted on the vehicle body and the hydraulically actuated component.

It is also known to measure the stroke of the piston within the hydraulic cylinder to determine the cylinder position. As described in CN-A-201121621, a rotary encoder is mounted at one end of and inside the cylinder. The rotary encoder has a wire which is attached to the piston rod. Movement of the piston, and therefore the piston rod, extends and retracts the wire, enabling the rotary encoder to measure the piston stroke (which is also known as the cylinder stroke) and from that to determine the position of the cylinder. However, in this type of arrangement the cylinder has to be modified to permit this type of arrangement. In particular the length of the cylinder needs to be increased to accommodate the encoder and associated apparatus.

It is an object of the present invention to provide improved apparatus for enabling the position of the cylinder of a hydraulic actuator to be determined.

SUMMARY

The present disclosure therefore provides a hydraulic actuator arrangement comprising:

- a hydraulic actuator comprising a cylinder having a bore in which a piston is slidably mounted for movement along the cylinder to extend and retract the hydraulic actuator, said cylinder comprising a side wall and a cylinder aperture extending through the side wall; and
- a wire actuated encoder mounted on the external surface of the cylinder, said wire actuated encoder comprising a wire which extends through the cylinder aperture and is attached to the piston for determining a stroke position of the piston within the cylinder.

The present disclosure also provides machine comprising at least a first member which is movable relative to a second member by means of a hydraulic actuator arrangement as described above.

The present disclosure further provides a retrofit kit for a hydraulic actuator, said hydraulic actuator comprising a cylinder having a bore in which a piston is slidably mounted for movement along the cylinder to extend and retract the hydraulic actuator, said cylinder comprising a side wall and a cylinder aperture extending through the side wall, said retrofit kit comprising:

- a wire actuated encoder for determining a stroke position of the piston within the cylinder;
- a mounting plate for externally mounting the wire actuated encoder to an external surface of the cylinder; and
- a connector for attaching the wire to the piston.

The present disclosure further provides a method of fitting a wire actuated encoder to a hydraulic actuator, said hydraulic actuator comprising a cylinder having a bore in which a piston is slidably mounted for movement along the cylinder to extend and retract the hydraulic actuator, said cylinder comprising a side wall, said method comprising the steps of:

- forming a cylinder aperture in the side wall of the cylinder;
- attaching a mounting plate to an external surface of the cylinder, said mounting plate having an aperture which is aligned with the cylinder aperture;
- removably attaching a mounting wire actuated encoder to the mounting plate; and
- attaching a wire of the wire actuated encoder to the piston.

BRIEF DESCRIPTION OF THE DRAWINGS

Preferred embodiments of the present disclosure will now be described with reference to, and as shown in, the accompanying drawings, in which.

DETAILED DESCRIPTION

The present disclosure is generally directed towards a hydraulic actuator arrangement suitable for use in a machine which has one or more members which are movable relative to another member by means of one or more hydraulic actuator arrangements. The members may be components and/or sections of components which are moved relative to each other and/or the machine. The hydraulic actuator arrangements generally comprise a hydraulic actuator and a wire actuated encoder for determining the position of a cylinder of the hydraulic actuator, which may be used to determine the position of the component.

Figure 1:
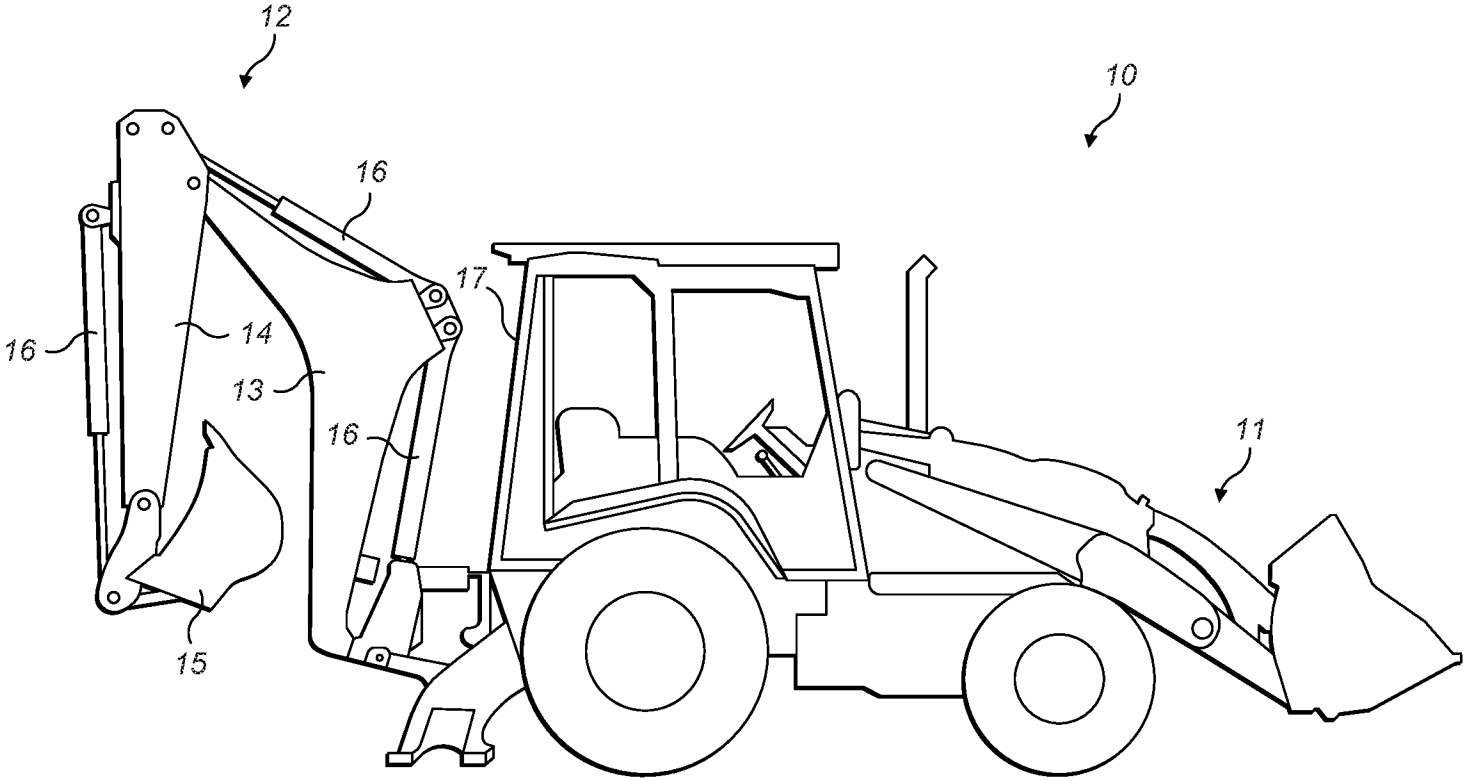
FIG. 1 is a side elevation of a prior art backhoe loader with a plurality of the hydraulic actuators.

FIG. 1 illustrates a prior art machine 10, in the form of a backhoe loader. In this example, the machine 10 has a first movable member 11, which may be in the form of a loader, located at the front of the machine 10 and a second movable member 12, which may be in the form of a backhoe, located at the rear of the machine 10. The first and second movable members 11,12 may be moved relative to the machine body 17 by means of one or more hydraulic actuators 16. However, in this disclosure only the operation of the second movable member 12 will be described for illustration purposes. The second movable member 12 may comprise a plurality of movable sections 13, 14. In this example a first movable section 13 may comprise a boom pivotally mounted at a first boom end to the machine 10 for movement in a generally vertical plane. A second movable section 14 may comprise a stick which may be pivotally mounted at a first stick end to a second boom end of the boom for movement in the same generally vertical plane in which the boom may move. A movable implement 15, which may be in the form of a bucket, may be pivotally mounted at a second stick end of the stick for pivotal movement in the same generally vertical plane in which the boom and stick may move. The first and second movable sections 13,14, and movable implement 15 may be moved relative to each other using one or more hydraulic actuators 16. In this example at least one hydraulic actuator 16 may be connected between the machine body 17 (or a component attached thereto) and the first movable section 13. At least one hydraulic actuator 16 may be connected between the first and second movable sections 13,14. At least one hydraulic actuator 16 may be connected between the second movable section 14 and the movable implement 15.

A hydraulic control system (not shown) may be used for controlling the movement of the first and second movable members 11, 12 via the hydraulic actuators 16. The hydraulic control system may be part of a more extensive hydraulic system (not shown), which may also control the operation of other functions of, and implements on, the machine 10. The hydraulic control system may be controlled by a system controller. The hydraulic control system may comprise a source of hydraulic fluid (not shown), which source may comprise a tank and a pump. The pump may be controlled by a control unit (not shown). The pump may draw hydraulic fluid required by the hydraulic actuator 16 from the tank and force the fluid under pressure into a supply line (not shown). Any hydraulic fluid drained from the hydraulic actuator 16 may be returned to the tank via a return line (not shown).

The hydraulic actuator arrangement of the present disclosure comprises a hydraulic actuator 16, as described above, with a wire actuated encoder 30 mounted thereon. The hydraulic actuator arrangement is shown in detail in FIGS. 2 and 3. The hydraulic actuator 16 comprises a piston 18 slidably located within a bore of the cylinder 19 in a known manner. The piston 18 may divide the bore of the cylinder 19 into a first chamber 20 and a second chamber 21. By supplying hydraulic fluid to one of the chambers 20,21 and allowing hydraulic fluid to drain from the other chamber 20,21, the piston 18 may be forced to slide along the cylinder 19 in the direction of the draining chamber 20,21. Movement of the piston 18 along the cylinder 19 in one direction may cause the hydraulic actuator 16 to extend. Movement of the piston 18 along the cylinder 19 in the opposite direction may cause the hydraulic actuator 16 to retract. The amount of extension or retraction of the hydraulic actuator 16 is used by the hydraulic actuator arrangement of the present disclosure to determine the position of the hydraulic actuator 16 (also known as cylinder sensing).

A piston rod 22 may be attached at a first piston rod end 23 to the piston 18 and moves with the piston 18. A second piston rod end 24 may be attached by suitable means to a first component (e.g. a boom which may be the first movable section 13) which is to be moved relative to a second component (e.g. a machine body 17). A first cylinder end 25 may be attached by suitable means to the second component. Movement of the piston 18 and the piston rod 22 may result in the movement of the first component relative to the second component (e.g. the raising or lowering of the boom relative to the machine body 17).

Figure 2:
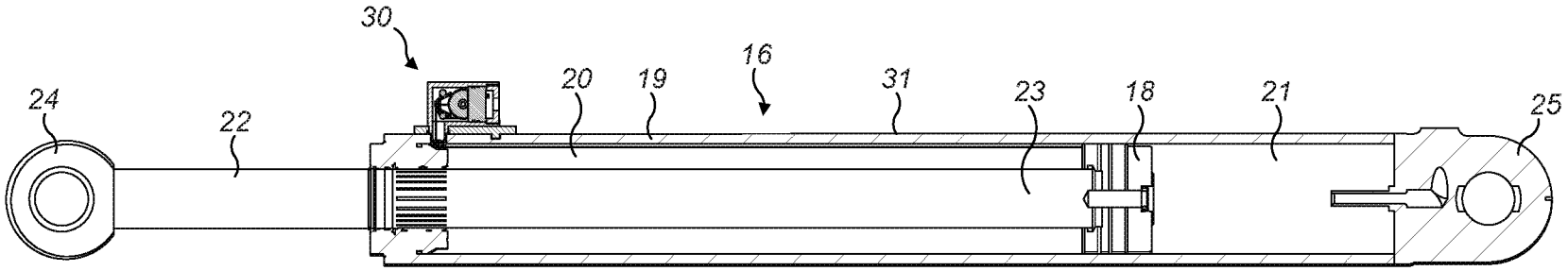
FIG. 2 is a cross-sectional side elevation of the hydraulic actuator arrangement of the present disclosure.
Figure 3:
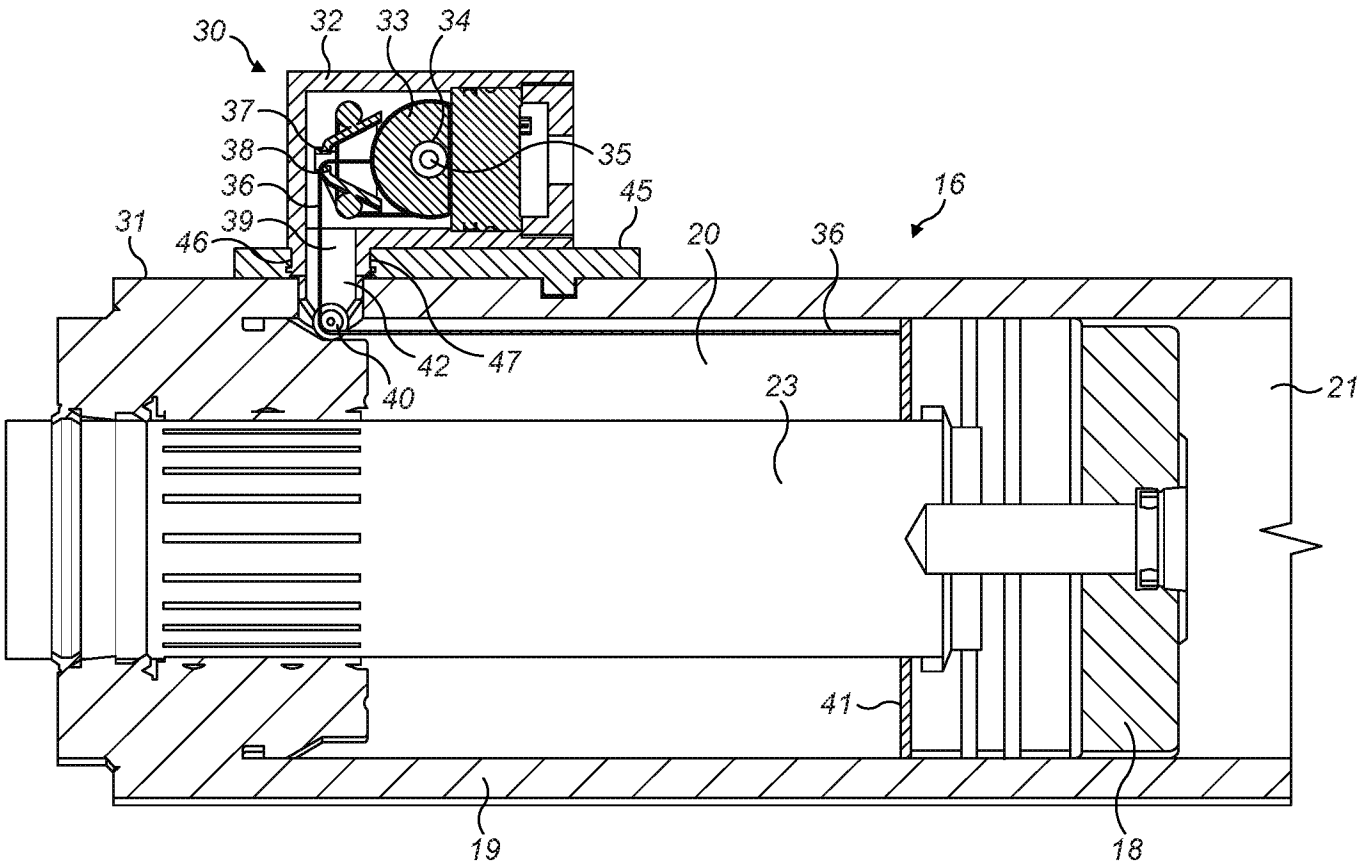
FIG. 3 is a magnified section of the cross-sectional side elevation of the hydraulic actuator arrangement of FIG. 2.
Figure 4:
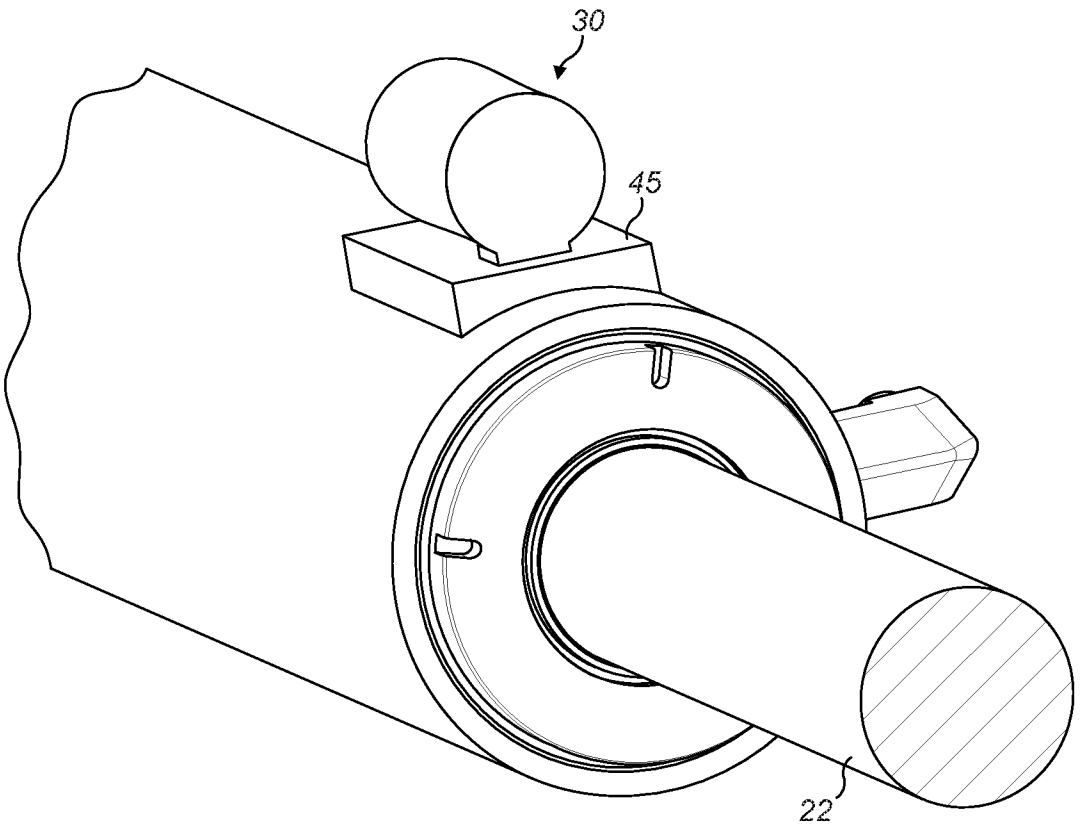
FIG. 4 is a perspective view of one end of the hydraulic actuator of FIG. 2.
Figure 6:
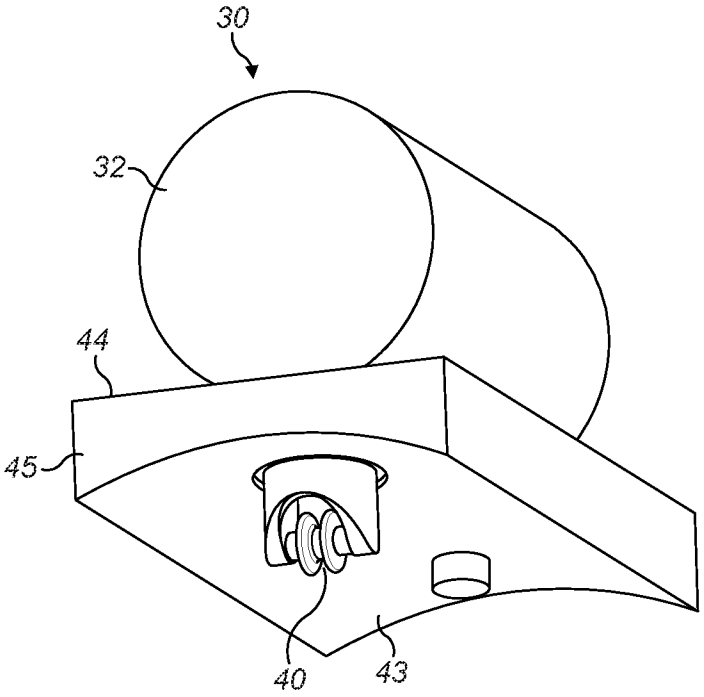
FIG. 6 is a perspective cross sectional view of the wire actuated encoder of FIG. 5.
Figure 5:
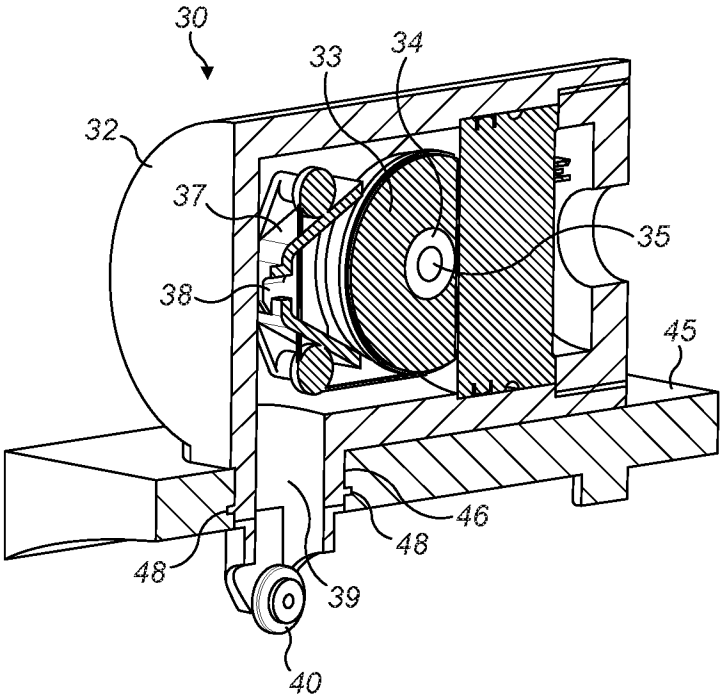
FIG. 5 is a perspective view of one end of the wire actuated encoder of the hydraulic actuator of FIG. 2.
Figure 7:
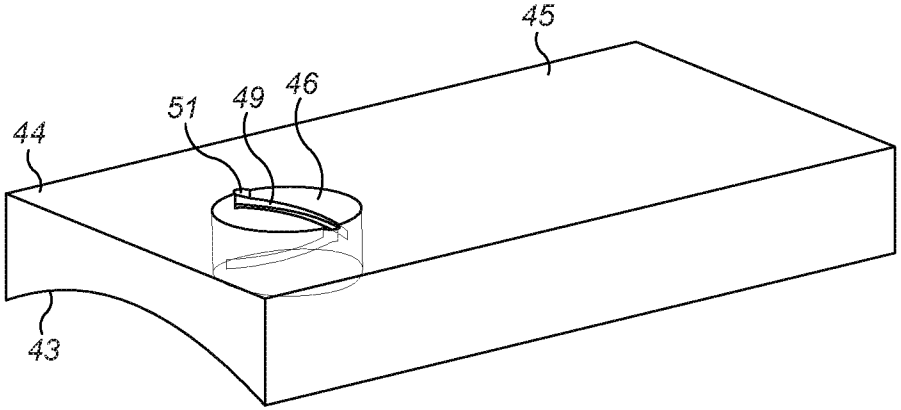
FIG. 7 is a perspective view of the mounting plate for mounting the wire actuated encoder to the cylinder of the hydraulic actuator arrangement of FIG. 2.
Figure 8:
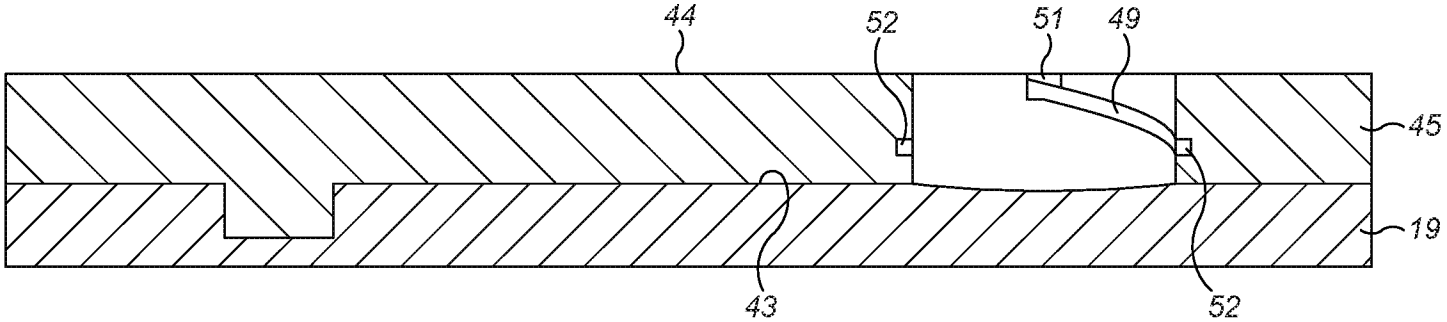
FIG. 8 is a cross sectional side elevation of the mounting plate of FIG. 7.

The wire actuated encoder 30 is mounted by a suitable mounting arrangement on an external surface 31 of the cylinder 19 at one end of the cylinder 19, as shown in FIGS. 2 to 4. The wire actuated encoder 30 may comprise a housing 32 and a drum 33 may be mounted in the housing 32. The drum 33 may have a hub 34 having a central aperture which is mounted on a spindle 35 attached to the housing 32, so that the drum 33 is able to rotate about the spindle 35. A length of wire 36 (or cable) may be attached at a first wire end to the hub 34 and the wire 36 may be wound around the hub 34. A first wire guide 37 may be mounted within the housing 32 adjacent the drum 33. The first wire guide 37 may be in the form of a nozzle having a wire guide aperture 38. The housing 32 may comprise a housing aperture 39. A second wire guide 40, which may be in the form of a rotable wheel, may be located adjacent the housing aperture 39. A cylinder aperture 42 may be formed in an external wall of the cylinder 19. The first and second wire guides 37, 40 may be designed to ensure the smooth running of the wire 36 from the hub 34 through the cylinder aperture 42.

The mounting arrangement may be selected to ensure that, when the wire actuated encoder 30 is mounted on the cylinder 19, the housing aperture 39 is aligned and communicates with the cylinder aperture 42 to provide a passage for the wire 36 from the housing 32 into the cylinder 19. The wire actuated encoder 30 may be mounted to the cylinder 19 by any suitable means, such as a mounting plate 45, as shown in FIGS. 3 to 8. The mounting plate may be attached to the external surface of the cylinder 19, for example by means of welding. The mounting plate 45 may have a first mounting plate surface 43 which is shaped to conform to the outer surface of the cylinder 19. The mounting plate 45 may have a second mounting plate surface 44 which is substantially flat to which the wire actuated encoder 30 is attached. The means for attaching the mounting plate 45 to the cylinder 19 may also be positioned to ensure that the housing aperture 39 communicates with the cylinder aperture 42.

The wire actuated encoder 30 may be attached and secured to the mounting plate 45. The attachment may permanent or may enable the wire actuated encoder 30 to be removably secured to the mounting plate 45. The attachment may be by means of interlocking locking members mounted on the wire actuated encoder 30 and the mounting plate 45. One suitable attachment may be a twist and lock mechanism which may be configured as follows. The mounting plate 45 may have a mounting plate aperture 46 which extends through the depth of the mounting plate 45 from a first mounting plate surface 43 to a second mounting plate surface 44. An internal surface of the mounting plate aperture 46 may have one or more recessed slots 49 spaced around the mounting plate aperture 46 which extend in a spiral orientation from the second mounting plate surface 44 partway through the mounting plate aperture 46. The width of the exposed ends 51 of the slots 49 at the second mounting plate surface 44 may be larger than the width of the slots 49. The housing 32 may have a hollow spigot 47 projecting therefrom which defines the housing aperture 39. The spigot 47 may have the same number of pegs 48 as there are slots 49, which pegs 48 project from an external surface of the spigot 47. The diameter or width of the pegs 48 is selected so that the pegs may slide along the slots 49.

Alternatively the housing 32 may be attached to the mounting plate 45 by means of bolts (not shown).

The wire actuated encoder 30 may be mounted to the cylinder 19 at an angle to suit the position of the hydraulic actuator 16 relative to the machine. This may be at a position which avoids any other components, such as a hydraulic inlet port.

The wire actuated encoder 30 may be connected to the machine 10 by means of an electrical harness (not shown) to provide power thereto. Conveniently the electrical harness may be attached to the hydraulic supply/return lines to the hydraulic actuator 16.

INDUSTRIAL APPLICABILITY

The wire actuated encoder 30 may be attached to a standard hydraulic actuator 16 without the need for substantial modification of the hydraulic actuator 16. As the wire actuated encoder 30 is mounted externally to the cylinder 16, it may be easily installed and is easily accessible for servicing or replacement.

The cylinder aperture 42 may be formed in the cylinder 19, for example during manufacture of the cylinder 19, and the mounting plate 45 attached to the cylinder 19. As the curvature of the mounting plate 45 may be selected according to the diameter of the cylinder 19, this may allow the same wire actuated encoder 30 arrangement to be the same for all diameters of cylinder 19. Thus the hydraulic actuator 16 may be prepared to receive the sensor at relatively low cost, and may allow the wire actuated encoder 30 to be fitted as an option during manufacture or easily installed as an after-market retrofit. If the wire actuated encoder 30 is fitted as an after-market retrofit, the hydraulic actuator 16 may need to be disassembled before the cylinder aperture 42 can be formed in the cylinder 19. A retrofit kit may comprise a wire actuated encoder 30, a mounting plate 45 and means for attaching the wire 36 to the piston 18. The kit may also include the means for attaching the mounting plate 45 to the cylinder 19. The arrangement described herein may also allow a wire actuated encoder 30 to be easily moved from one machine 10 to another.

The wire actuated encoder 30 may attached to the mounting plate 45 during manufacture or assembly of the hydraulic actuator 16 or as a retrofit. In the embodiment described above, the spigot 47 is inserted into the mounting plate aperture 46 such that pegs 48 may be located in the exposed ends 51 of the slots 49. The wire actuated encoder 30 may be twisted relative to the mounting plate 45, which may drive the pegs 48 along the slots 49 until they reach the internal ends 52 of the slots 49. At this point the wire actuated encoder 30 may be in a locked position in the correct orientation relative to the cylinder 19. An O-ring (not shown) may be mounted around the spigot 47 so that it is located against the housing 32. When the wire actuated encoder 30 is in its locked position, the O-ring is fully seated between the mounting plate 45 and the housing 32.

When the wire actuated encoder 30 is mounted on the cylinder 19, the cylinder aperture 42 may be aligned so as to communicate with the housing aperture 39. The wire 36 may be guided from the drum 33 to the housing aperture 39 through the wire guide aperture 38 in the first wire guide 37, and from the housing aperture 39 into the cylinder 19 through the cylinder aperture 42 to the second wire guide 40. The second wire guide 40 may guide the wire 36 along the bore of the cylinder 19. In the example illustrated in FIGS. 2 and 3, the wire 36 may be turned through two 90° angle, although other configurations may be used. The path of the wire 36 may vary depending on the specific configuration of the wire actuated encoder 30 and the orientation in which the wire actuated encoder 30 is mounted to the cylinder 19. The wire 36 passes along the cylinder 19 alongside the piston rod 22 and a second wire end may be attached to a first piston face 41. The attachment may be made by any suitable means, for example a threaded insert. The wire 36 may alternatively be attached to the piston 18 before the wire actuated encoder 30 is attached to the mounting plate 45.

As the piston 18 travels along the cylinder 19 in one direction (e.g. as the hydraulic actuator 16 contracts), the wire 36 may be pulled in the same direction by the piston 18 so that the wire 36 unwinds from the drum 33 which rotates in a first direction (e.g. counter clockwise) thereby extending the unwound length of the wire 36. The drum 33 may be spring loaded, so that the wire 36 is able to unwind but, as it unwinds, the wire 36 remains taught. As the piston 18 travels along the cylinder 19 in an opposite direction (e.g. as the hydraulic actuator 16 extends), the wire 36 may be pushed back in the opposite direction. The spring loading of the drum 33 may cause the drum 33 to rotate in a second direction which is opposite to the first direction (e.g. clockwise) to wind the wire 36 back on the drum 33, thereby reducing the unwound length of the wire 36.

The wire actuated encoder 30 is a position measuring system, which is be configured to measure the stroke of the piston 18, as it moves from one end of the cylinder 19 to the other which causes the hydraulic actuator to move between a fully retracted and a fully extended hydraulic actuator position. The piston stroke measurement is achieved by measuring the distance of travel of the piston 18 along the cylinder 19. When the wire actuated encoder 30 has been mounted to the cylinder 19 and the wire 36 attached to the piston 18, it may be calibrated by measuring maximum and minimum wire extension positions, which correspond to the maximum contraction and extension of the hydraulic actuator 16. From these measurements, any position of the hydraulic actuator 16 may be determined. The wire actuated encoder 30 may be configured to generate an encoder signal corresponding to the stroke position of the piston 18 and therefore the stroke of the hydraulic actuator 16. The encoder signals may be pulse-width modulation signal, which is transmitted to the system controller of the machine 10. The system controller may use the encoder signal to determine the actual position of the hydraulic actuator 16 and/or the actual position of the components and/or sections of components between which the hydraulic actuator 16 is connected.

The encoder signal may be used by the system controller to control various machine features. One such feature is cylinder snubbing, which is where the velocity of the piston 18 is slowed as the hydraulic actuator 16 approaches full extension or retraction. The encoder signal may be combined with a kinematic model of the working structure of the machine 10 (e.g. an excavation structure) to produce a position system of a movable implement 15 (such as the bucket). The external mounting of the wire actuated encoder 30 means that a traditional hydro mechanical snubbing arrangement (illustrated in the second chamber 21 of FIG. 2) may be used.

What is claimed is:

1. A hydraulic actuator arrangement comprising:

a hydraulic actuator comprising a cylinder having a bore in which a piston is slidably mounted for movement along the cylinder to extend and retract the hydraulic actuator, said cylinder comprising a side wall and a cylinder aperture extending through the side wall; and a wire actuated encoder mounted on an external surface of the cylinder, said wire actuated encoder comprising a wire which extends through the cylinder aperture and is attached to the piston for determining a stroke position of the piston within the cylinder; and a mounting arrangement comprising, a mounting plate attached to the external surface of the cylinder and the wire actuated encoder attached to the mounting plate, and interlocking members located on the wire actuated encoder and the mounting plate respectively, wherein the mounting arrangement is configured such that, when the wire actuated encoder is externally mounted on the cylinder, the wire is directed into the cylinder.

2. A hydraulic actuator arrangement as claimed in claim 1, wherein the wire actuated encoder comprises a housing, which has a housing aperture through which the wire passes, and wherein the mounting arrangement is configured to align the housing aperture with the cylinder aperture when the wire actuated encoder is mounted on the cylinder.

3. A hydraulic actuator arrangement as claimed in claim 1 in which the mounting plate comprises a mounting plate aperture located such that, when the wire actuated encoder is mounted on the mounting plate, the mounting plate aperture is aligned with the housing aperture and the cylinder aperture.

4. A hydraulic actuator arrangement as claimed in claim 1 in which the wire actuated encoder is removably attached to the mounting plate.

5. A hydraulic actuator arrangement as claimed in claim 1 in which the interlocking members comprise at least one locking peg projecting from a spigot extending from a housing of the wire actuated encoder and at least one slot located inside a mounting plate aperture in the mounting plate.

6. A hydraulic actuator arrangement as claimed in claim 1 in which the mounting arrangement comprises bolts for attaching the wire actuated encoder to the mounting plate.

7. A hydraulic actuator arrangement comprising:

a hydraulic actuator comprising a cylinder having a bore in which a piston is slidably mounted for movement along the cylinder to extend and retract the hydraulic actuator, said cylinder comprising a side wall and a cylinder aperture extending through the side wall; and a wire actuated encoder mounted on an external surface of the cylinder, said wire actuated encoder comprising a wire which extends through the cylinder aperture and is attached to the piston for determining a stroke position of the piston within the cylinder; and a wire guide configured to guide the wire from the cylinder aperture along the cylinder bore to the piston.

8. A hydraulic actuator arrangement comprising:

a hydraulic actuator comprising a cylinder having a bore in which a piston is slidably mounted for movement along the cylinder to extend and retract the hydraulic actuator, said cylinder comprising a side wall and a cylinder aperture extending through the side wall; and a wire actuated encoder mounted on an external surface of the cylinder, said wire actuated encoder comprising a wire which extends through the cylinder aperture and is attached to the piston for determining a stroke position of the piston within the cylinder; and a wire guide configured to guide the wire from the wire actuated encoder to the cylinder aperture.

* * * * *